United States Patent [19]

de Montalembert

[11] Patent Number: 4,570,302

[45] Date of Patent: Feb. 18, 1986

[54] DEVICE FOR RETAINING AN ARTICLE ON AN ITEM OF CLOTHING

[76] Inventor: Bernard de Montalembert, 9, rue Saint-Louis, 77300 Fontainebleau, France

[21] Appl. No.: 660,955

[22] Filed: Oct. 15, 1984

[30] Foreign Application Priority Data

Oct. 17, 1983 [CH] Switzerland ..... 5637/83

[51] Int. Cl.[4] ..... A45C 13/18

[52] U.S. Cl. ..... 24/3 H; 24/3 R; 24/3 J; 150/134

[58] Field of Search ..... 24/3 H, 3 R, 3 A, 3 J, 24/3 K, 3 L; 150/134

[56] References Cited

U.S. PATENT DOCUMENTS

| | | | |
|---|---|---|---|
| 523,178 | 7/1894 | Saripkin | 150/134 |
| 652,245 | 6/1900 | Cameron | 24/3 H |
| 1,041,664 | 10/1912 | Olson | 150/134 |
| 1,171,836 | 2/1916 | Campbell | 24/3 H |
| 1,194,809 | 8/1916 | Bigney | 24/3 K |
| 2,536,469 | 1/1951 | Schechter | 150/134 |
| 2,823,434 | 2/1958 | Van Buren, Jr. | 24/3 K |
| 2,869,198 | 1/1959 | Clevett, Jr. | 24/3 K |
| 3,273,619 | 9/1966 | de Azevedo | 24/3 H |
| 4,355,440 | 10/1982 | Johansson et al. | 24/3 H |

FOREIGN PATENT DOCUMENTS

| | | | |
|---|---|---|---|
| 974005 | 2/1951 | France | 24/3 R |
| 1207148 | 2/1960 | France . | |

*Primary Examiner*—Victor N. Sakran

*Attorney, Agent, or Firm*—Kane, Dalsimer, Kane, Sullivan and Kurucz

[57] ABSTRACT

The device comprises a staple provided with means for attaching it to the article to be retained, for example a billfold. This staple supports a steel wire, which is bent so as to form simultaneously a spike crossing the staple from one wing to the other and a control means provided with a cap. When the staple is placed in a pocket, the spike penetrates into the fabric when an effort is made to withdraw the billfold. The spike can be retracted by applying pressure to the cap, the wire coming to rest on the base of the cut-out of the staple. Locking means formed by a lug and a groove in the cap make it possible to prevent axial movement of the cap.

9 Claims, 10 Drawing Figures

DEVICE FOR RETAINING AN ARTICLE ON AN ITEM OF CLOTHING

BACKGROUND OF THE INVENTION

The present invention relates to a device for retaining an article on an item of clothing, for example retaining a billfold in a pocket, the device being intended to be attached to the article to be retained, and comprising a rigid U-shaped staple provided with means for attachment to the said article, on which staple are mounted, on the one hand, a resilient member the end of which is intended to penetrate into the item of clothing on which the said article is located, in case of relative movement tending to separate the said article from the said item of clothing, and, on the other hand, a control means mounted to slide on the staple between two positions, the said resilient member being aligned obliquely, from one wing of the staple to the other, towards the base of this staple, in a first position of the control means, and being moved away from the opposite wing in the second position of the control means.

THE PRIOR ART

The billfold security device, of the type mentioned above, is described in French Pat. No. 1,207,148. In this prior art device, the resilient member is formed by a curved leaf spring attached by a rivet to one of the wings of the staple, the end of the said spring bearing, at rest, against the opposite wing of the staple, by one edge. A slide enables the spring to be straightened against the wing to which it is attached. The edge by which the spring bears on the fabric is liable to cut or tear the fabric. The releasing of the spring, which is accomplished by rotation, may likewise result in tearing of the fabric.

Needle devices (French Pat. No. 462,520, U.S. Pat. No. 3,273,619, German Pat. No. 403,398) are furthermore known which comprise a needle aligned obliquely upwards and capable of being retracted by means of a sliding member. In all these embodiments, the needle is not covered in the working position and may injure the user when the wallet is manipulated. In the devices according to U.S. Pat. No. 3,273,619 and German Pat. No. 403,398, the spring is released by gravity, requiring absolute cleanness, which is difficult to maintain, in order to enable the sliding piece to slide.

SUMMARY OF THE INVENTION

The primary object of the invention is to provide a simpler device which is reliable and non-hazardous to use and does not spoil the fabric.

For this purpose, in the device according to the invention, a single wire simultaneously forms the sliding member and the retaining member, in this case a spike. Retraction of the spike is accomplished by a combined translatory and rotatory movement, permitting the spike to be withdrawn from the fabric without risking tearing it. More precisely the control means and the resilient means are formed by a single piece comprising a resilient, bent and pointed metal wire, the part of the wire possessing the spike passing obliquely through one of the wings of the staple through a cut-out so as to reach, at least approximately, the opposite wing, in the first position of the control means, and to move away from the opposite wing, flexing and bearing on one end of the cut-out, in the second position of the control means, in a manner such that the spike moves away from the opposite wing, performing a combined translatory and rotatory movement.

In a preferred embodiment of the invention, the device can be rendered inoperable by simply pressing on a cap located in the extension of the staple. This cap can moreover be locked by rotation, unlocking having to be performed by bringing two profiles into alignment, which can only be done visually.

THE DRAWINGS

The attached drawing illustrates, by way of example, a preferred embodiment of the invention.

FIG. 1 is a frontal view of the device seen from the interior of a billfold, FIG. 2 is a lateral view, FIG. 3 is a frontal view of the device seen from the exterior of a billfold, FIG. 4 is an end view, FIG. 5 is a view of the staple alone in the same position as in FIG. 1, FIG. 6 is a view of the staple alone in the same position as in FIG. 4, FIG. 7 is a view of the metal wire alone, corresponding to the position shown in FIG. 1, FIG. 8 is a view of the metal wire alone in the position shown in FIG. 2.

FIG. 9 is a view of the metal wire alone in the position shown in FIG. 4, and FIG. 10 is a partial view of a wallet equipped with the device.

DESCRIPTION OF THE PREFERRED EMBODIMENT

Figure 2:
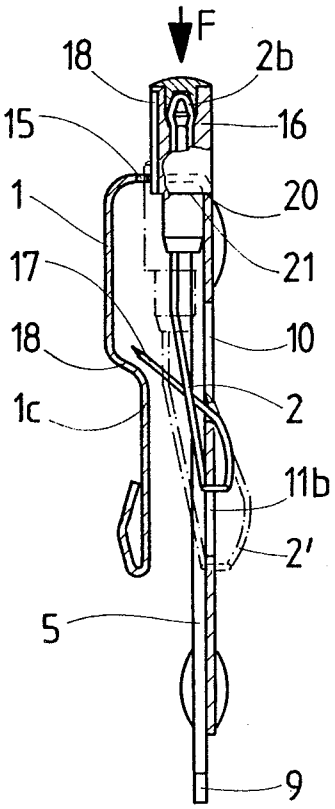
Figure 1:
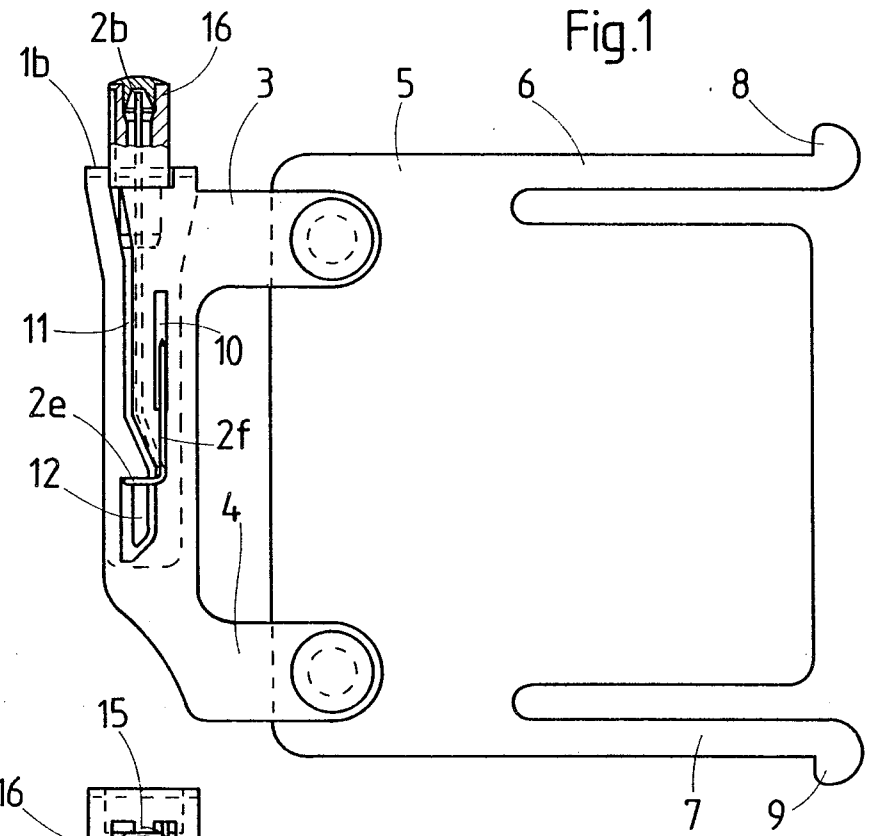
Figure 4:
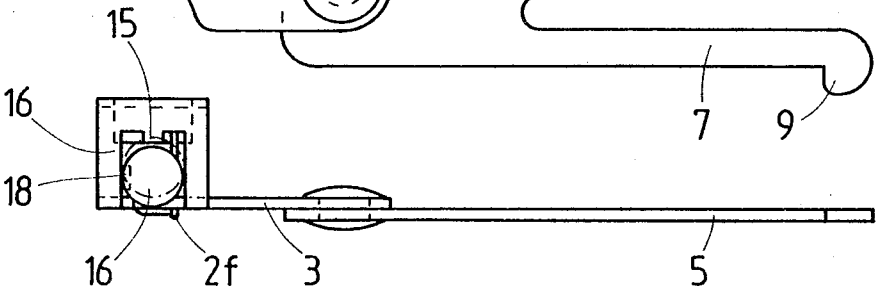
Figure 3:
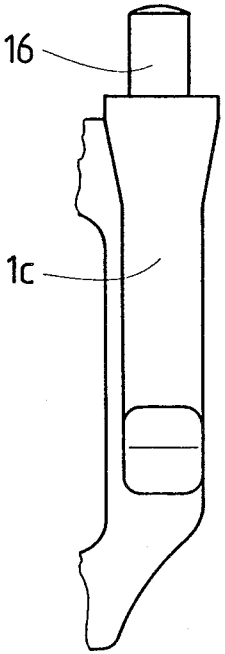

The device illustrated essentially comprises a metal staple 1 and a bent steel wire 2. The staple is provided with two legs 3 and 4 by which it is attached by means of rivets to a plate 5 of semi-rigid plastic provided with two resilient arms 6 and 7 cut out of the plate 5, the ends 8 and 9 of these arms being angled outwards.

Figure 5:
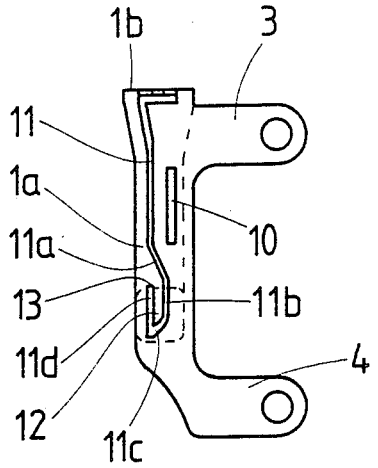
Figure 6:
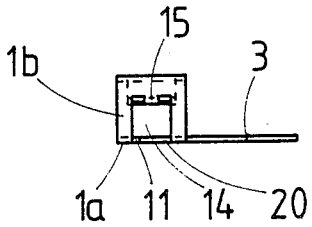
Figure 7:
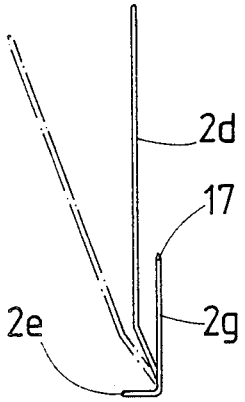
Figure 8:
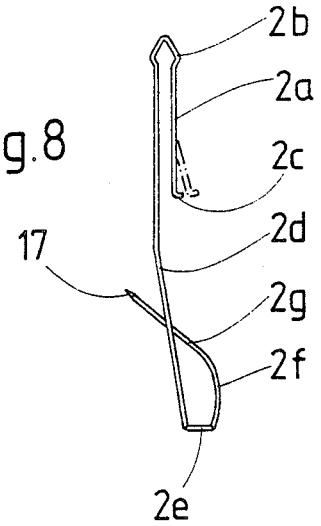
Figure 9:
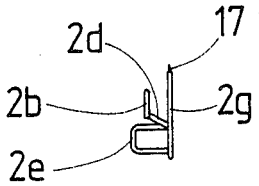

The wing 1*a* of the staple 1 which is integral with the legs 3 and 4 has a first longitudinal cut-out 10 of rectangular shape, extending over approximately ⅓ of the length of the staple, in the central part thereof, and being of a width slightly greater than the diameter of the wire 2. Parallel to this cut-out 10 there extends a second cut-out 11, from the base 1*b* of the staple almost to its end. This cut-out 11, of the same width as the cut-out 10, has a part extending parallel to the cut-out 10 over the length of the latter, followed by an oblique part 11*a* connecting the first part to a part 11*b* located in the extension of the cut-out 10, this part 11*b* being connected by an oblique part 11*c* to an end part 11*d* located in the extension of the first part 11. The parts 11*b*, 11*c* and 11*d* define a finger 12, while the base of the part 11*d* forms a stop 13 (FIG. 5). The other end of the cut-out 11 terminates in a rectangular cut-out 14 made in the base 11*b* of the staple (FIG. 6). This cut-out 14 has a lug 15 whose function will be explained below.

The steel wire 2 mounted on the staple 1 has a first part 2*a* angled in the form of a pin intended to be introduced into a cylindrical cap 16, in a cavity whereof the said wire is retained by the angle 2*b* which forms an approximately triangular loop. The lower end of the cap 16 can moreover come to abut against the angled end 2*c*. Below the cap 16, the wire has a first oblique part 2*d* which comes to enclose the finger 12 by means of a part 2*e* folded into a U, thus passing to the outside of the staple 1 by a part *2f*, this part *2f* being followed by an oblique rectilinear part *2g* passing through the cut-out 10, the end of this part *2g* forming a spike 17. In the normal working position, this spike 17 is oriented toward the wing *1c* of the staple and is located in the vicinity of an angle 18 serving as a stop limiting the flexion of the wire 1, as will be described below.

The cap 16 is able to rotate on the wire 2. It has a lower part of reduced diameter forming a circular bearing 21 interrupted by a longitudinal exterior groove 18 of a width slightly greater than the width of the lug 15 and extending over the upper part of the cap. When this groove 18 is opposite the lug 15, as shown in FIG. 2, the upper part of the cap can freely pass through the cut-out 14. In any other angular position, the bearing 21 of the cap 16 abuts against the edge 20 of the cut-out 14 opposite the lug 15 (FIG. 2). The edge 20 is slightly below the part *1b* of the staple, so that, at rest, the upper part of the cap 16 is slightly engaged in the cut-out 14. The cap 16 is then held laterally between the wing *1a* of the staple, by its lower part, and the lug 15.

Figure 10:
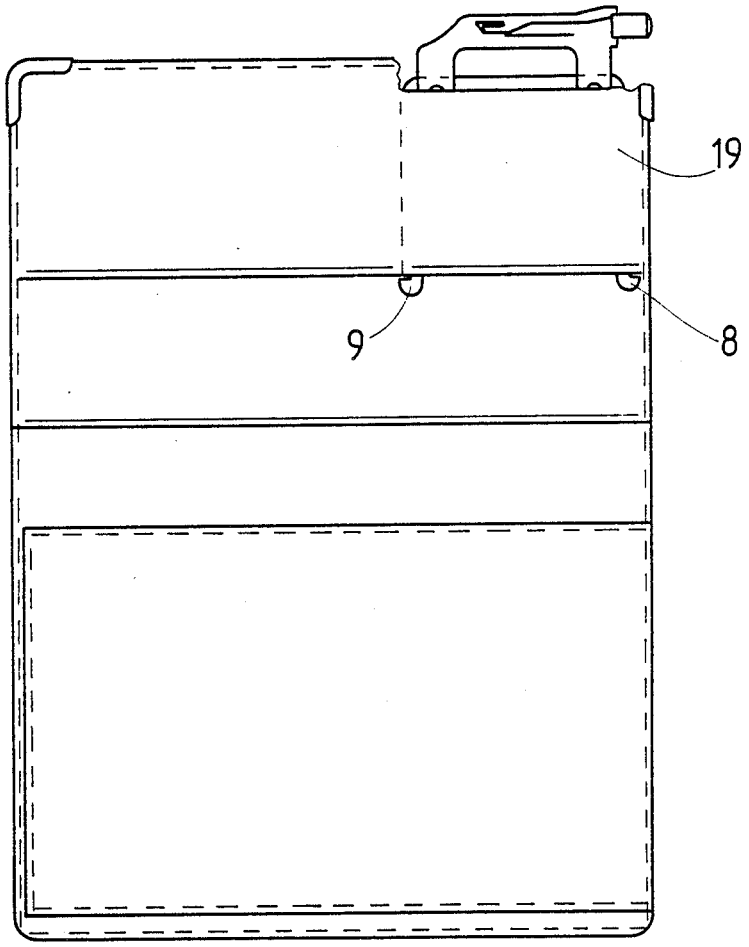

The device is attached to the billfold as shown in FIG. 10. The only special feature which the billfold must possess is a loop 19 of a width corresponding to the width of the plate 5, excluding the ends 8 and 9, and of a length corresponding to this plate. To attach the device, it is sufficient to introduce the plate 5 into the loop 19, flexing the arms 6 and 7. Once these arms have passed through the loop 19, the plate hooks onto the billfold by its angled ends 8 and 9. This assembly procedure can be performed very rapidly by the user.

The mode of operation of the device is as follows:

The cap 16 being placed in any locked position, the billfold is introduced into the pocket in a manner such that the staple 1 is situated either side of the pocket. During this introduction, the spike 17 slide over the fabric, flexing and not spoiling the fabric. If the billfold moves outwards relative to the pocket, whether in the course of attempted theft or accidentally, the spike 17 then penetrates the fabric, retaining the billfold. If the traction on the billfold continues, the spike 17 passes through the fabric and abuts against the angle 18 of the staple which limits the flexion of the wire and ensures that the device is locked on the clothing.

When the carrier of the billfold wishes to withdraw his billfold, he has merely to rotate the cap 16 to bring the groove 18 in line with the lug, which enables the cap to be moved away from the edge 20 and an axial pressure to be exerted on the cap, as indicated by the arrow F in FIG. 2. During this axial movement, the part *2g* of the wire 2 comes to abut against the lower end of the cut-out 10, the result of which is to cause the part *2g* of the wire to flex and to move it away from the wing *1c* of the staple, this taking place in a combined translatory and rotatory movement which enables the spike 17 to be extracted from the fabric without tearing or spoiling the latter. In its movement, the wire is furthermore guided on the finger 12 by its coiled part *2e*. When the pressure on the cap 16 is released, the latter automatically returns backwards since the part *2g* of the wire tends to return to its initial position, still resting against the end of the cut-out 10 which produces a reaction tending to push the wire back upwards.

The upper part of the cut-out 11 which terminates in the cut-out 14 is used to mount the wire 2 on the staple 1. For this purpose, the part *2a* of the wire is passed through the cut-out 11 before the cap 16 is threaded on this part *2a*.

The device may be fixed to any article capable of being put in a clothing pocket, such as a billfold, notebook, purse, pen, radio receiver, etc. Its staple can be attached to any part of a garment capable of receiving it, such as a hip pocket, belt, etc. The device can also be used to retain an item of clothing on another item of clothing, for example a woman's skirt on a belt, to prevent the skirt from riding up above the belt, or conversely by attaching the device to the belt. The staple could of course be permanently attached to the article by any other means.

The invention is of course suitable for numerous alternative embodiments without departing from the scope of the invention as defined by the claims.

What is claimed is:

1. A device for retaining an article on an item of clothing, for example retaining a billfold in a pocket, the device being intended to be attached to the article to be retained, and comprising a rigid U-shaped staple provided with means for attachment to the said article, on which staple are mounted, a resilient member the end of which is intended to penetrate into the item of clothing on which the said article is located, in case of relative movement tending to separate the said article from the said item of clothing, and, a control means mounted to slide on the staple between two positions, the said resilient member being aligned obliquely, from one wing of the staple to the other, towards the base of this staple to the other, towards the base of this staple, in a first position of the control means, and being moved away from the opposite wing in the second position of the control means, wherein the said control means and the said resilient means are formed by a single piece comprising a resilient, bent and pointed metal wire, said resilient member and staple cooperating to urge said control means toward said first position, the part of the wire possessing the spike passing obliquely through one of the wings of the staple through a cut-out so as to reach, at least approximately, the opposite wing, in the first position of the control means, and to move away from the opposite wing, flexing and bearing on one end of the cut-out, in the second position of the control means, in a manner such that the spike moves away from the opposite wing, performing a combined translatory and rotatory movement.

2. A device as claimed in claim 1, wherein the said opposite wing of the staple possesses a stop restricting the flexion of the spike towards the end of the wing.

3. A device as claimed in claim 2, wherein the stop is formed by an angled part of the wing.

4. A device as claimed in claim 1, wherein the part of the wire forming the control means passes through the base of the staple via an aperture and is provided with a cap held axially on the wire.

5. A device as claimed in claim 4 wherein the cap is free to rotate on said wire and said device further comprises means for locking said cap axially by rotation on the staple.

6. A device as claimed in claim 4, wherein the cap is cylindrical and possesses two parts of different diameters defining a bearing intended to abut axially against the edge of the aperture of the base of the staple, this bearing being interrupted by a groove parallel to the axis and provided on the part of large diameter, so as to define the profile to which corresponds a profile of the aperture of the staple, so that the bringing into alignment of the profiles permits the said bearing to pass through the said aperture and hence permitting the movement of the wire.

7. A device as claimed in claim 1, wherein the wing of the staple supporting the pointed part of the metal wire possesses a second cut-out extending from the base of the staple to approximately the end of the wing and having a part parallel to the first cut-out followed by an oblique part, a part aligned with the first cut-out, a transverse part, and a part aligned with the said parallel part so as to form a notch in the wing of the staple, and wherein the bent metal wire, from the manipulating means, passes between the wings of the staple, then passes through the second cut-out via the said notch, before passing back through the wing of the staple by the first cut-out.

8. A device as claimed in claim 7, wherein the metal wire forms a loop around the finger formed between the notch and the part of the second cut-out which is parallel to the notch.

9. A device as claimed in claim 1, wherein the staple is attached to a semi-rigid plate extending laterally wherein are cut-out two resilient arms whose ends are angled outwards in a manner such as to permit the plate to be introduced into a loop of the article to be retained and to be engaged by the angled ends.

* * * * *